US010529295B2

(12) United States Patent
Chen et al.

(10) Patent No.: US 10,529,295 B2
(45) Date of Patent: Jan. 7, 2020

(54) DISPLAY APPARATUS AND GATE-DRIVER ON ARRAY CONTROL CIRCUIT THEREOF

(71) Applicant: RICHTEK TECHNOLOGY CORPORATION, Zhubei, Hsinchu (TW)

(72) Inventors: Chien-Chung Chen, Hsinchu (TW); Hsing-Shen Huang, Hsinchu (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 15/980,269

(22) Filed: May 15, 2018

(65) Prior Publication Data

US 2018/0366082 A1 Dec. 20, 2018

Related U.S. Application Data

(60) Provisional application No. 62/521,392, filed on Jun. 17, 2017.

(30) Foreign Application Priority Data

Feb. 6, 2018 (TW) ..... 107104087 A

(51) Int. Cl.
*G09G 3/36* (2006.01)

(52) U.S. Cl.
CPC ... *G09G 3/3674* (2013.01); *G09G 2310/0213* (2013.01); *G09G 2310/0289* (2013.01); *G09G 2310/061* (2013.01); *G09G 2310/08* (2013.01); *G09G 2330/027* (2013.01); *G09G 2354/00* (2013.01)

(58) Field of Classification Search
CPC ... G09G 3/3611; G09G 3/3674; G09G 3/3677
See application file for complete search history.

(56) References Cited

U.S. PATENT DOCUMENTS

| | | | | |
|---|---|---|---|---|
| 7,471,286 | B2 | 12/2008 | Chung | |
| 9,013,468 | B2 | 4/2015 | Choi et al. | |
| 9,595,219 | B2 | 3/2017 | Shim et al. | |
| 2002/0186211 | A1* | 12/2002 | Akai | G09G 3/3659 345/204 |
| 2015/0364114 | A1 | 12/2015 | Smith et al. | |
| 2018/0025691 | A1* | 1/2018 | Ota | G09G 3/36 345/96 |

* cited by examiner

*Primary Examiner* — Roy P Rabindranath
(74) *Attorney, Agent, or Firm* — Tung & Associates

(57) ABSTRACT

A display apparatus includes a timing controller and a gate-driver on array (GOA) control circuit. The timing controller generates a frame synchronization signal. The GOA control circuit is coupled to the timing controller and includes a scan signal management circuit and a level shifter. The scan signal management circuit generates a scan signal management signal according to the frame synchronization signal, a predetermined panel parameter, and an operation clock signal. The scan signal management circuit includes a storage unit which stores the predetermined panel parameter. The level shifter generates a scan control signal according to the scan signal management signal to control a GOA of a display panel circuit. The GOA generates a gate driving signal to control a vertical scan operation of the display panel circuit.

18 Claims, 9 Drawing Sheets

DISPLAY APPARATUS AND GATE-DRIVER ON ARRAY CONTROL CIRCUIT THEREOF

CROSS REFERENCE

The present invention claims priority to U.S. 62/521,392, filed on Jun. 17, 2017, and to TW 107104087, Feb. 6, 2018.

BACKGROUND OF THE INVENTION

Field of Invention

The present invention relates to a display apparatus. Particularly it relates to a display apparatus with fewer signal lines. The present invention also relates to a gate-driver on array (GOA) control circuit for use in the display apparatus.

Description of Related Art

FIG. 1 shows a prior art display apparatus (display apparatus 1) disclosed in U.S. Pat. No. 9,595,219B2, wherein a timing controller (Tcon) 110 controls a level shifter 130 to generate scanning management signals (such as CLK, VST, VRST shown in the figure) which control the GOA 140 to generate the gate driving signal GL for controlling the vertical scanning operation of the display panel unit 100A. The display panel 100 includes plural display panel units (such as 100A) which are arranged in a two dimensional array with plural rows and plural columns. The aforementioned vertical scanning operation indicates that the rows of the display panel 100 are sequentially selected along the vertical direction.

The prior art circuit in FIG. 1 has a drawback that the output signals of the timing controller 110 substantially are in a one-to-one relationship with the scanning management signals. Therefore, the total number of the signal lines between the timing controller 110 and the level shifter 130 is enormously large in high resolution display panel applications, which leads to high cost and design difficulty. Besides, such kind of display apparatus architecture is usually dedicated for display panels of one single model which has one set of predetermined panel parameters. Such architecture is not applicable to display panels of different models with various different panel parameters.

Compared to the prior art in FIG. 1, the present invention is advantageous in higher flexibility which can support various models of display panels and in lower overall cost of the display apparatus.

Relevant prior patents are U.S. Pat. Nos. 9,595,219B2, 7,471,286B2 and 9,013,468B2, which solve the issue by different approaches from the present invention.

SUMMARY OF THE INVENTION

From one perspective, the present invention provides a display apparatus, comprising: a timing control circuit, configured to operably generate a frame synchronization signal; and a gate-driver on array (GOA) control circuit which is coupled to the timing control circuit, including: a scanning signal management circuit, configured to operably generate a scanning signal management signal according to the frame synchronization signal, a predetermined panel parameter and an operation clock signal, wherein the scanning signal management circuit includes a storage unit configured to store the predetermined panel parameter; and a level shifter circuit, configured to operably generate a scanning control signal according to the scanning signal management signal to control a gate-driver on array of a display panel circuit, wherein the gate-driver on array generates a gate driving signal according to the scanning control signal to control a vertical scanning operation of the display panel circuit.

In one embodiment, the GOA control circuit further includes an oscillator which is configured to operably generate the operation clock signal.

In one embodiment, the timing control circuit provides the operation clock signal.

In one embodiment, the operation clock signal is not provided from outside the GOA control circuit.

In one embodiment, the operation clock signal is synchronous with the frame synchronization signal.

In one embodiment, the operation clock signal is synchronous or not synchronous with a vertical scanning frequency of the display panel circuit.

In one embodiment, the predetermined panel parameter is one of the followings: (1) a fixed value, (2) a selectable fixed value; or (3) an adjustable value; wherein the predetermined panel parameter is stored into the storage unit by a user in a setting stage.

In one embodiment, the scanning control signal includes at least one of the followings: (1) a GOA phase control signal for controlling a phase and/or a waveform of the gate driving signal; (2) a life extension control signal for controlling a life extension operation of the gate driving signal; and/or (3) a power off signal for controlling a power off operation of the gate driving signal.

In one embodiment, the predetermined panel parameter includes at least one of the followings: (1) a phase number of the GOA phase control signal; (2) a phase overlay parameter of the GOA phase control signal; (3) a transient waveform parameter of the GOA phase control signal; (4) a life extension control signal related parameter; and/or (5) a power off signal related parameter.

In one embodiment, the scanning signal management circuit further includes at least one of the followings: a phase number control unit, configured to operably determine the phase number of the GOA phase control signal; a phase overlay control unit, configured to operably adjust the phase overlay among the phases of the GOA phase control signal; a transient control unit, configured to operably control a transient waveform of the GOA phase control signal; a blanking control unit, configured to operably control a horizontal blanking time or a vertical blanking time; a life extension control unit, configured to operably generate the life extension control signal; and/or a power off control unit, configured to operably generate the power off signal.

In one embodiment, none of any signal lines connected between the timing control circuit and the GOA control circuit includes (1) a signal line dedicated only for transmitting the GOA phase control signal, (2) a signal line dedicated only for transmitting the life extension control signal, or (3) a signal line dedicated only for transmitting the power off signal.

From another perspective, the present invention provides a gate-driver on array (GOA) control circuit for use in a display apparatus, the display apparatus including: a timing control circuit, configured to operably generate a frame synchronization signal; and the GOA control circuit, coupled to the timing control circuit, the GOA control circuit comprising: a scanning signal management circuit, configured to operably generate a scanning signal management signal according to the frame synchronization signal, a predetermined panel parameter and an operation clock signal, wherein the scanning signal management circuit includes a storage unit which stores the predetermined panel parameter; and a level shifter circuit, configured to operably generate a scanning control signal according to the scanning signal management signal to control a gate-driver on array of a display panel circuit, wherein the gate-driver on array generates a gate driving signal according to the scanning control signal to control a vertical scanning operation of the display panel circuit.

The objectives, technical details, features, and effects of the present invention will be better understood with regard to the detailed description of the embodiments below.

DESCRIPTION OF THE PREFERRED EMBODIMENTS

The drawings as referred to throughout the description of the present invention are for illustration only, to show the interrelations between the circuits and the signal waveforms, but not drawn according to actual scale.

Figure 1:
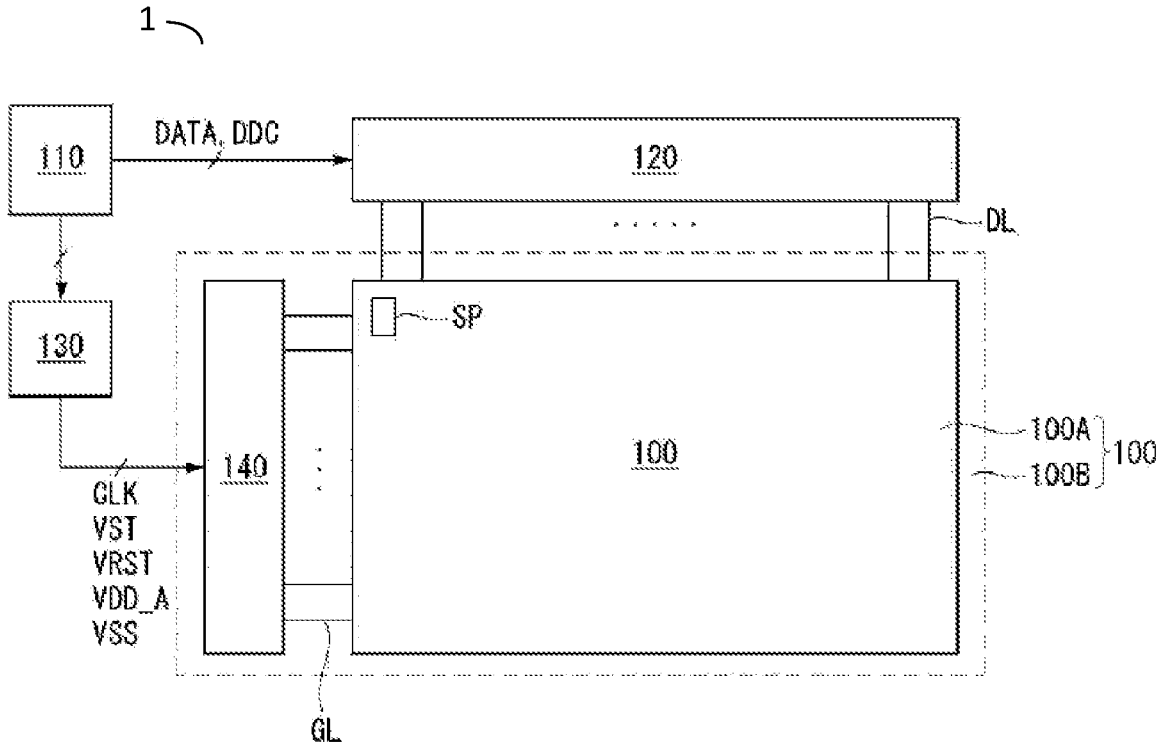
Fig. 1 (prior art)
FIG. 1 shows a block diagram of a prior art display apparatus.
Figure 2:
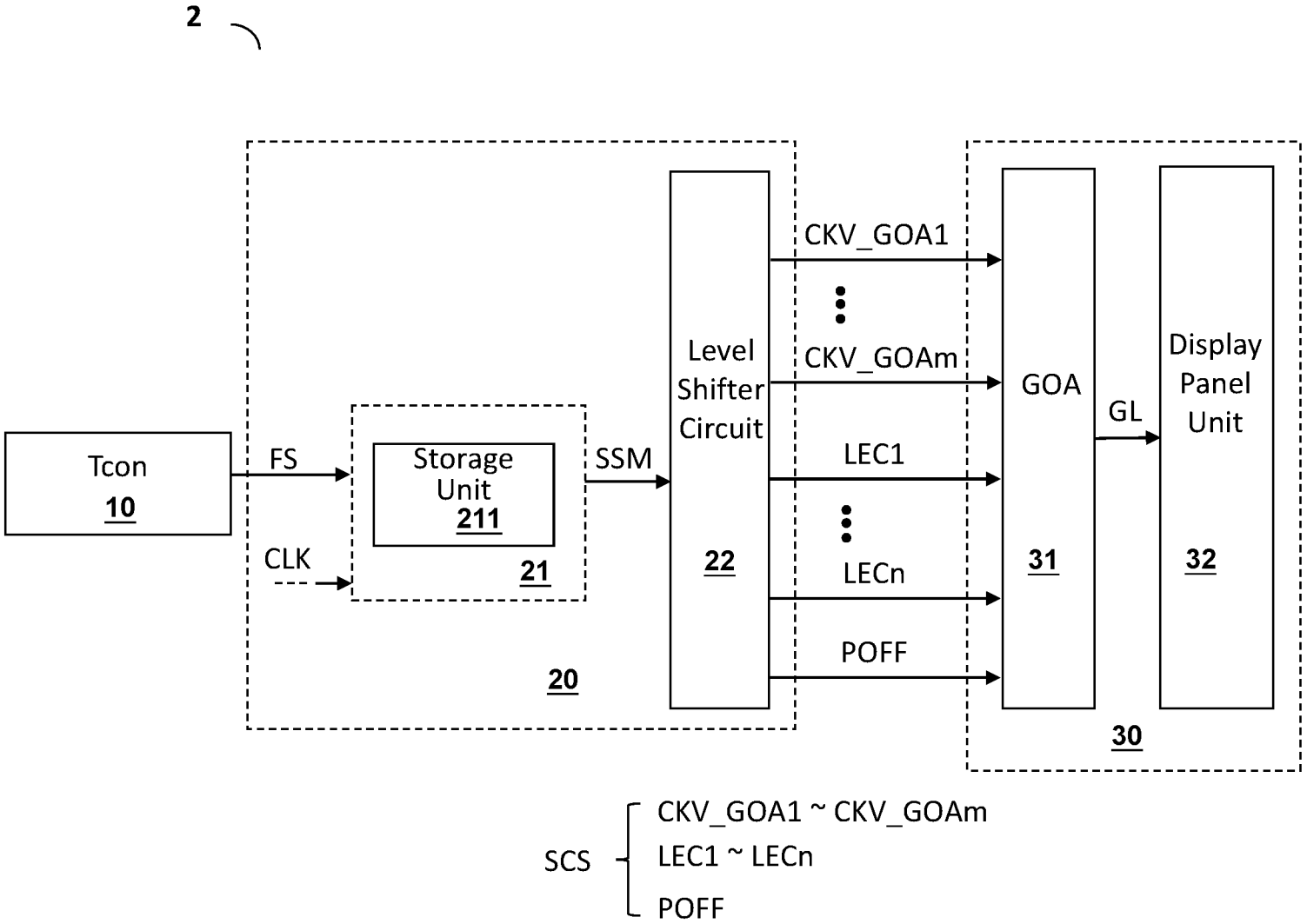
FIG. 2 shows a block diagram of an embodiment of the display apparatus according to the present invention.

FIG. 2 shows a block diagram of an embodiment of the display apparatus (display apparatus 2) according to the present invention. The display apparatus 2 comprises a timing control circuit 10 and a gate-driver on array (GOA) control circuit 20. The timing control circuit 10 is configured to operably generate a frame synchronization signal FS. The GOA control circuit 20 is coupled to the timing control circuit 10, and includes a scanning signal management circuit 21 and a level shifter circuit 22. The scanning signal management circuit 21 generates a scanning signal management signal SSM according to the frame synchronization signal FS, a predetermined panel parameter and an operation clock signal CLK, wherein the scanning signal management circuit 21 includes a storage unit 211 which stores the predetermined panel parameter. The level shifter circuit 22 generates a scanning control signal SCS according to the scanning signal management signal SSM, to control a gate-driver on array 31 of a display panel circuit 30 (for example but not limited to a TFT LCD display panel), wherein the gate-driver on array 31 generates a gate driving signal GL according to the scanning control signal SCS to control a vertical scanning operation of the display panel circuit 30. Specifically, as shown in FIG. 2, the gate-driver on array 31 controls the vertical scanning of the display panel unit 32 by the gate driving signal GL, to display an image.

The aforementioned frame synchronization signal FS refers to a clock signal which is synchronous with a frame update rate of the display panel circuit 30, for synchronizing the displayed images. In one embodiment, the frequency of the frame synchronization signal FS is the same as the frame update rate of the display panel circuit 30.

Still referring to FIG. 2, in one embodiment, the scanning control signal SCS includes at least one of the followings: (1) a GOA phase control signal CKV_GOA for controlling a phase and/or a waveform of the gate driving signal GL; (2) a life extension control signal LEC for controlling a life extension operation of the gate driving signal GL; and/or (3) a power off signal POFF for controlling a power off operation of the gate driving signal GL. In one embodiment, the GOA phase control signal CKV_GOA includes m phases of sub GOA phase control signals such as CKV_GOAL~CKV_GOAm as shown in the figure, wherein m is a positive integer. In one embodiment, the life extension control signal LEC includes n sub life extension control signals which are encoded or not encoded, such as LEC1~LECn as shown in the figure, wherein n is a positive integer. In one embodiment, the scanning signal management signal SSM has one-to-one correspondence with the aforementioned scanning control signal SCS.

Display panel circuits made by different manufacturers may vary in for example but not limited to at least one of the following parameters: the vertical resolution, the phase number of the gate driving signal GL, the transient waveform requirements of the gate driving signal GL, life extension operations of the gate driving signal GL, and/or signal requirements for power off operation, etc. An advantage of the present invention is that the display apparatus of the present invention can be applied to different types of display panel circuits provided by different manufacturers. The details will be described later.

Figure 3A:
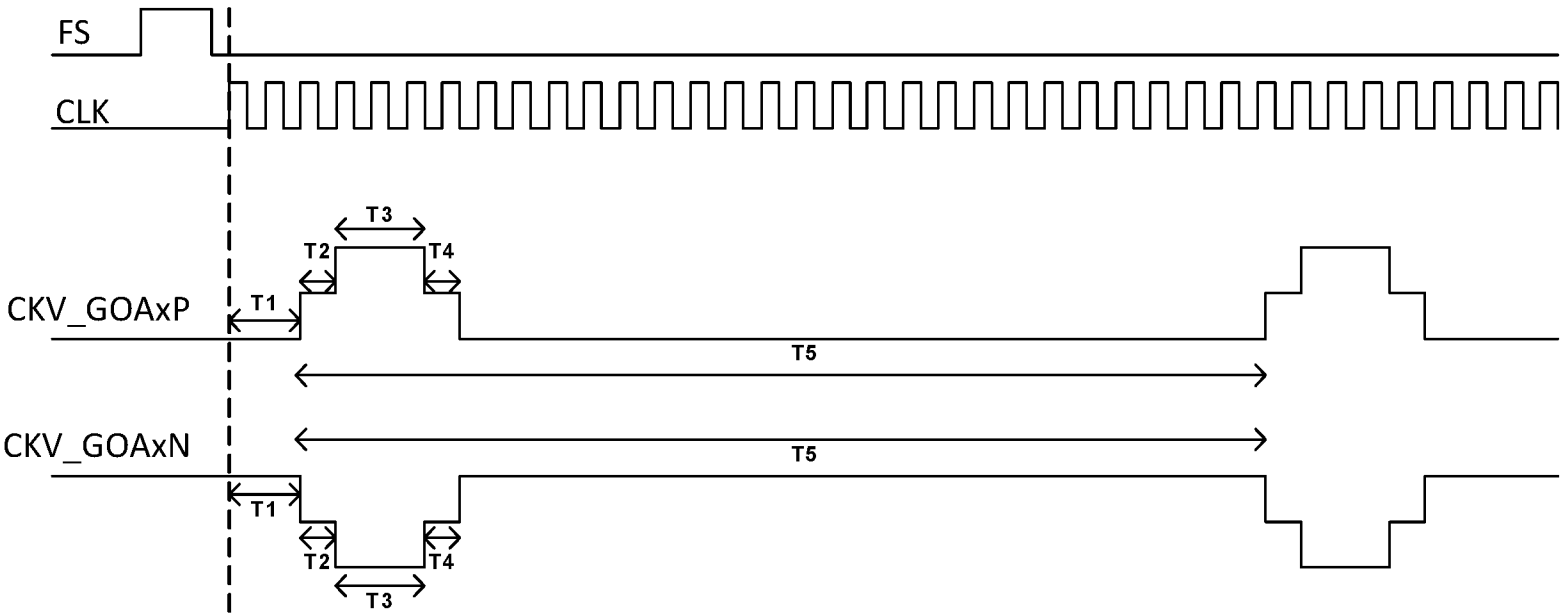
FIGS. 3A-3C show schematic waveforms corresponding to the embodiments of the present invention.
Figure 3B:
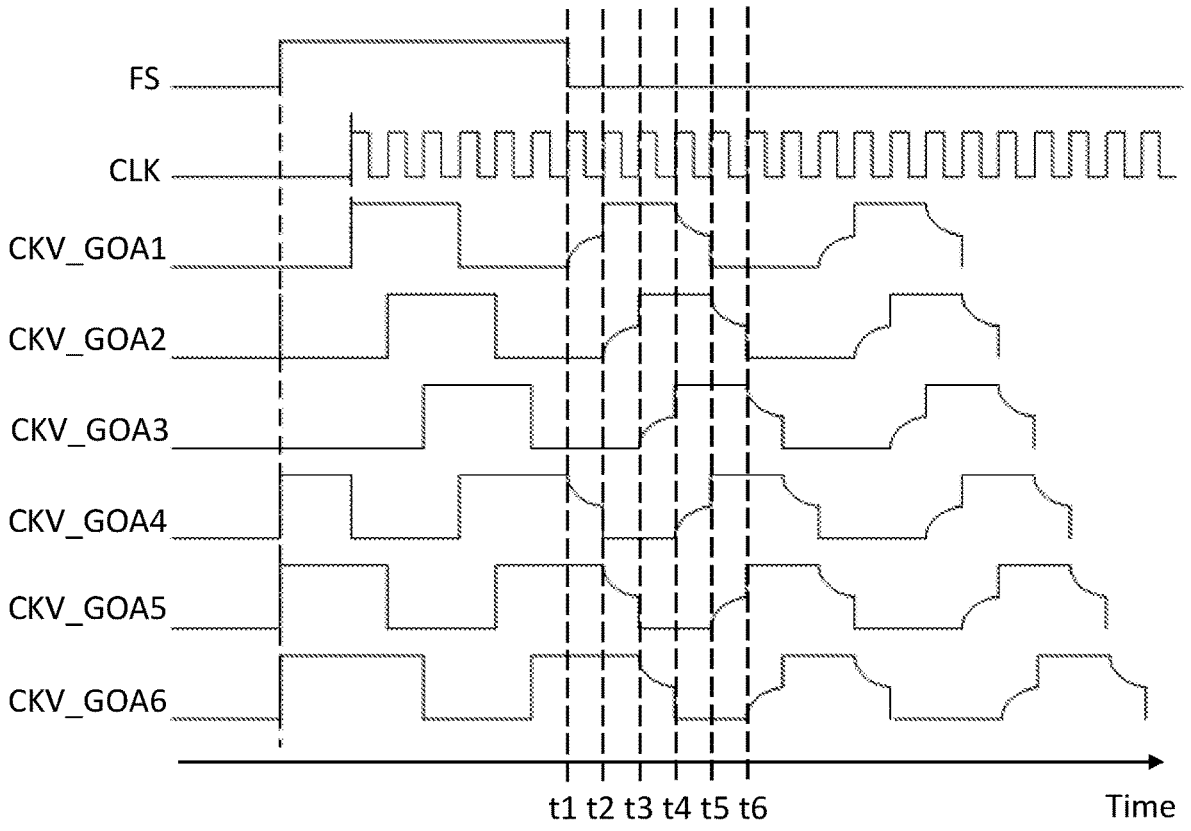
Figure 3C:
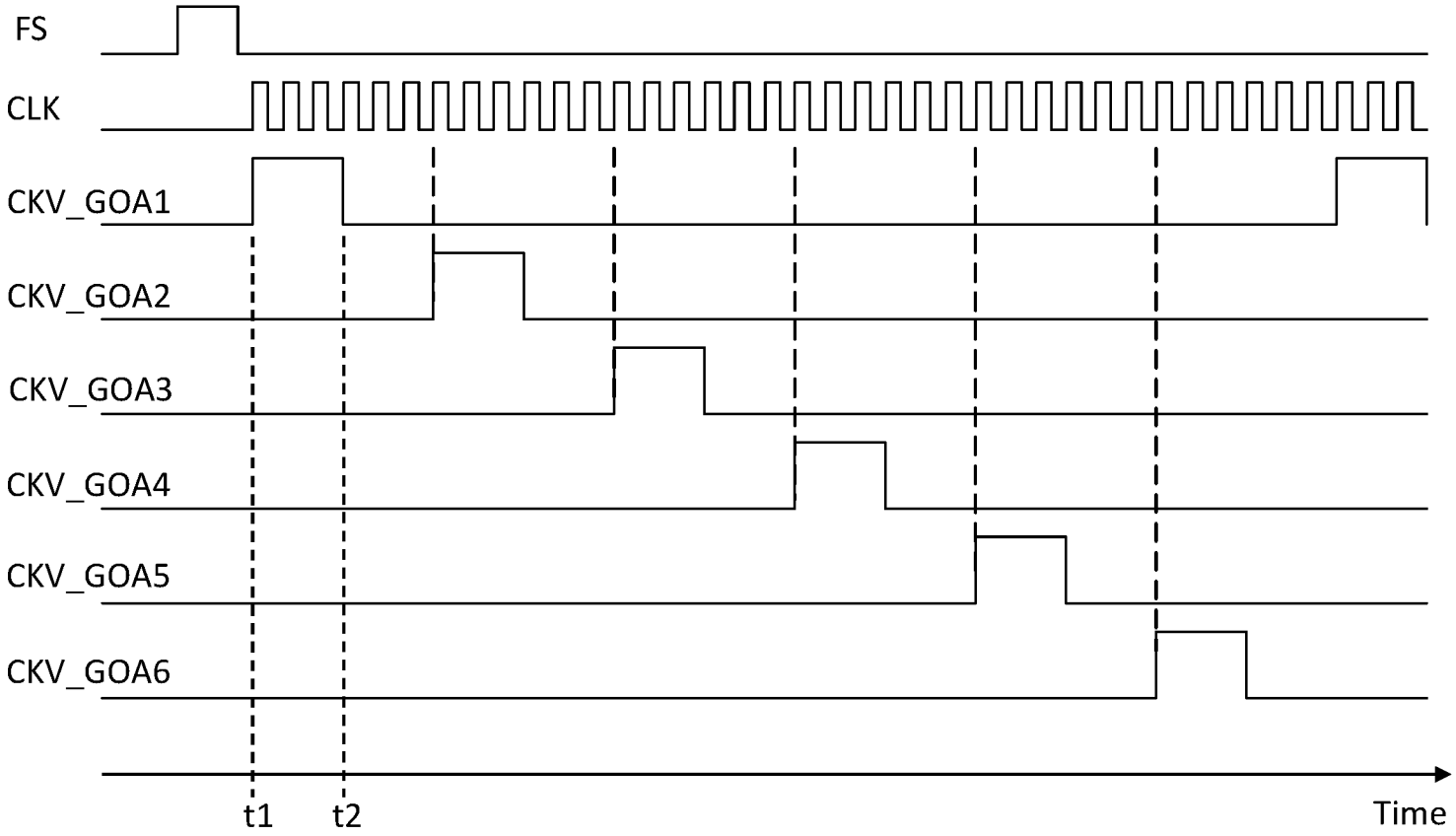

FIGS. 3A-3C show schematic waveforms corresponding to the embodiments of the present invention. For different requirements, the GOA control circuit (for example GOA control circuit 20) can generate different corresponding GOA phase control signals CKV_GOA to control the gate-driver on array 31 to generate different corresponding gate driving signals GL. More specifically: FIG. 3A shows a first example; in this embodiment, the GOA phase control signal includes a pair of complement sub GOA phase control signals CKV_GOAxP and CKV_GOAxN. According to the requirements of the display panel circuit in this embodiment (for example a charge sharing control type), the rising edges and the falling edges of the sub GOA phase control signals CKV_GOAxP and CKV_GOAxN are required to be divided into multiple sections, as shown by T1-T5 in FIG. 3A. FIG. 3B shows another example; in this embodiment, the GOA phase control signal includes for example but not limited to 6 phases, i.e. sub GOA phase control signals CKV_GOA1~CKV_GOA6 as shown in FIG. 3B. According to the requirements of the display panel circuit in this embodiment, the sub GOA phase control signals CKV_GOAL~CKV_GOA6 need to overlay with one another with a certain predetermined relationship. For example, sub GOA phase control signals CKV_GOA1 and CKV_GOA2 overlay with each other during a period from time point t2 to time point t5. Besides, as shown in FIG. 3B, in this embodiment, during display scanning phase, for example after the time point t1, it is required to shape (such as beveling or rounding) the rising edges and/or the falling edges of the sub GOA phase control signals CKV_GOAL~CKV_GOA6 to provide the required transient waveforms (for example, see the waveform of the sub GOA phase control signal CKV_GOAL during t1-t2).

FIG. 3C shows another example; in this embodiment, the conduction periods of the sub GOA phase control signals CKV_GOAL~CKV_GOA6 are not required to overlay with one another (see, e.g., the conduction period t1-t2 of CKV_GOAL, which does not overlay with the conduction period of CKV_GOA2). Besides, in this embodiment, it is not required to shape the transient waveforms of the GOA phase control signals, either.

In addition, according to different requirements, the GOA control circuit (for example GOA control circuit 20) can generate different corresponding life extension control signals LEC for extending the life span of the display panel circuit or the display apparatus. In one embodiment, the life extension control signal LEC can control the timing of driving the display panel circuit with an inverse phase. In one embodiment, the life extension control signal LEC can enable sub driving circuits of the display apparatus in turn to extend the overall life span of the display apparatus.

Similarly, according to different requirements, the GOA control circuit (for example GOA control circuit 20) can generate different corresponding power off signals POFF to control the power off operation of the display panel circuit.

According to different requirements of different panel specifications, the predetermined panel parameter stored in the storage unit 211 may include at least one of the following parameters of the display panel unit 32: a vertical or horizontal resolution, a frame update rate, blanking time related parameters (such as number or time length of the blanking time periods), a phase number of the GOA phase control signal, a phase overlay parameter of the GOA phase control signal, a transient waveform parameter of the GOA phase control signal, a life extension control signal related parameter and a power off signal related parameter, to generate the corresponding scanning control signal SCS (i.e. the GOA phase control signal, the life extension control signal and the power off signal).

Figure 4:
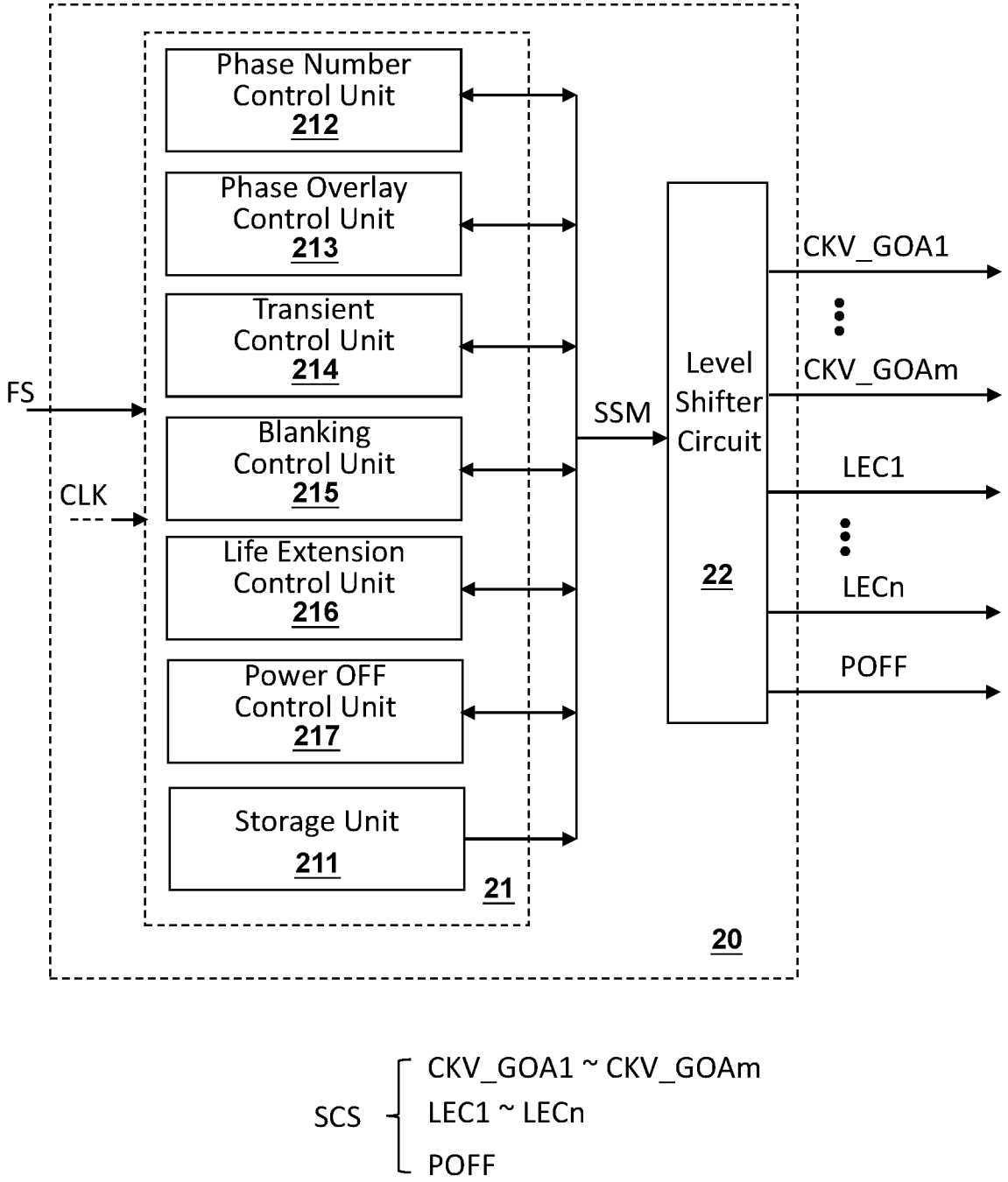
FIG. 4 shows a schematic diagram of an embodiment of the GOA control circuit of the display apparatus according to the present invention.

FIG. 4 shows a schematic diagram of a specific embodiment of the GOA control circuit (GOA control circuit 20) of the display apparatus according to the present invention. In this embodiment, the scanning signal management circuit 21 further includes at least one of the followings: a phase number control unit 212, a phase overlay control unit 213, a transient control unit 214, a blanking control unit 215, a life extension control unit 216, and a power off control unit 217. These control units generate the corresponding the scanning signal management signal SSM according to the frame synchronization signal FS, the predetermined panel parameters and the operation clock signal CLK, to control the level shifter circuit 22 to generate the scanning control signal SCS. The phase number control unit 212 determines the phase number of the GOA phase control signal to provide a corresponding GOA phase control signal. The phase overlay control unit 213 adjusts the phase overlay among the phases of the GOA phase control signal. The transient control unit 214 controls a transient waveform of the GOA phase control signal. The blanking control unit 215 controls the number or time length of a horizontal blanking time or of a vertical blanking time. The life extension control unit 216 generates the life extension control signal LEC. The power off control unit 217 generates the power off signal POFF.

Figure 5:
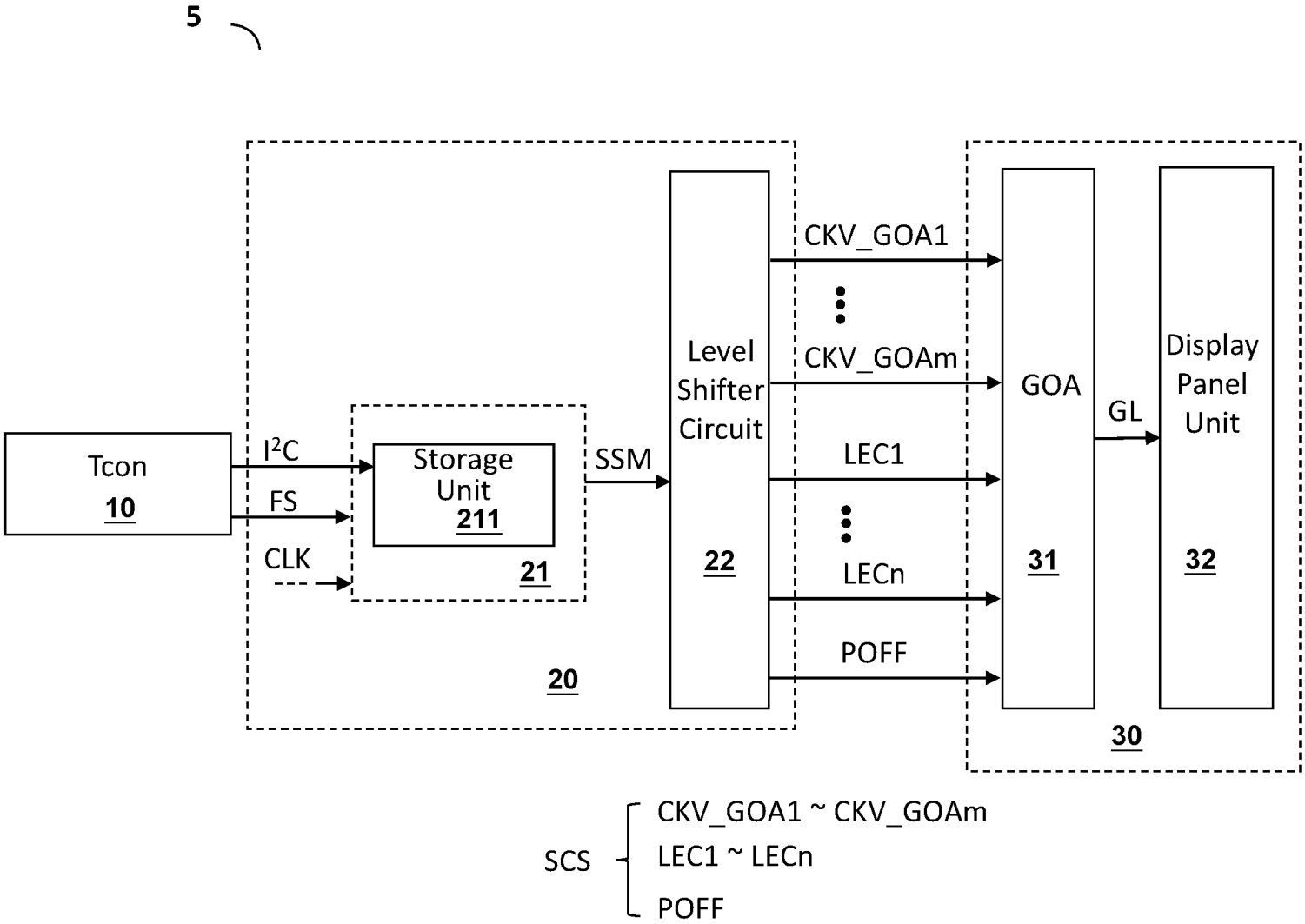
FIG. 5 shows a block diagram of an embodiment of the display apparatus according to the present invention.

The display apparatus of the present invention can be applied to a single type or multiple types of display panels. In one embodiment, the predetermined panel parameter may be one of the followings: (1) a fixed value, (2) a selectable fixed value; or (3) an adjustable value. In the embodiment with an adjustable predetermined panel parameter, the predetermined panel parameter is stored into the storage unit 211 by a user in a setting stage. The setting stage may be a time period during for example when the display panel is being manufactured or after the display apparatus has been powered up but not yet started to display images by scanning operation. In one embodiment, the predetermined panel parameter can be stored into the storage unit 211 by the timing control circuit 10. Note that the present invention is different from the prior art in that the predetermined panel parameters are static. In other words, according to the present invention, the panel parameter is transferred between the timing control circuit and the GOA control circuit and stored into the storage unit 211 only during the aforementioned setting stage by for example but not limited to serial data communication interface such as $I^2C$ (as shown in FIG. 5). On the contrary, in the prior art circuits, the signal lines between the timing controller and the GOA control circuit are dynamically operating, i.e., the signals transmitted in between correspond to the scanning control signal in real time, and hence the prior art circuits require a very large number of the signal lines between the timing controller and the GOA control circuit. According to the present invention, in one embodiment, the signal line between the timing control circuit 10 and the GOA control circuit 20 may consist of one and only one signal line, i.e. the frame synchronization signal FS, and the GOA control circuit 20 can generate the aforementioned various kinds of scanning control signals by itself according to the predetermined panel parameters stored in the storage unit 211. In another embodiment, the signal lines between the timing control circuit 10 and the GOA control circuit 20 may consist of the frame synchronization signal FS and the operation clock signal CLK, which is still much simpler than the prior art circuits.

Figure 6:
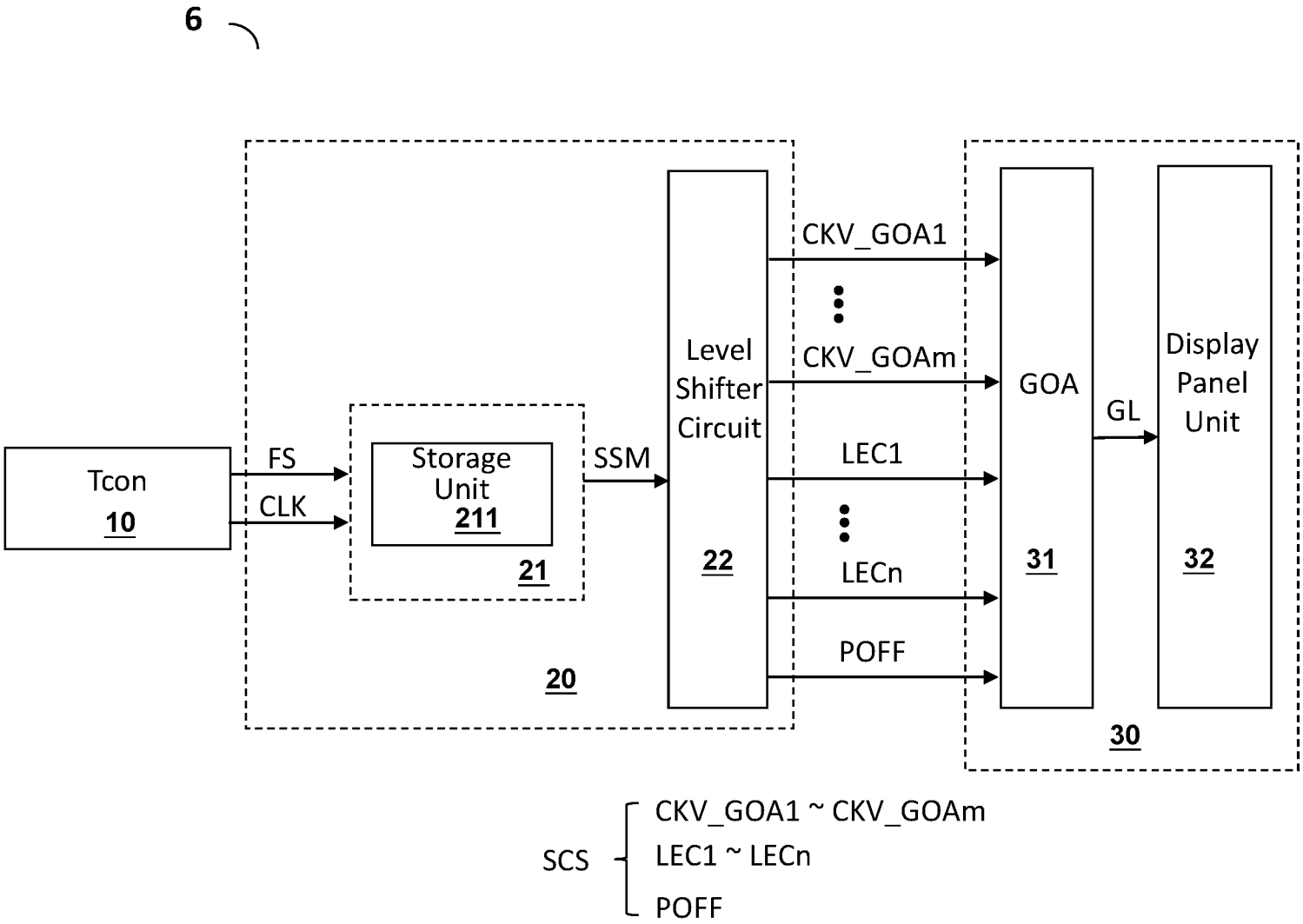
FIG. 6 shows a block diagram of an embodiment of the display apparatus according to the present invention.

FIG. 6 shows a block diagram of another embodiment of the display apparatus (display apparatus 6) according to the present invention. In this embodiment, the operation clock signal CLK is provided by the timing control circuit 10.

Figure 7:
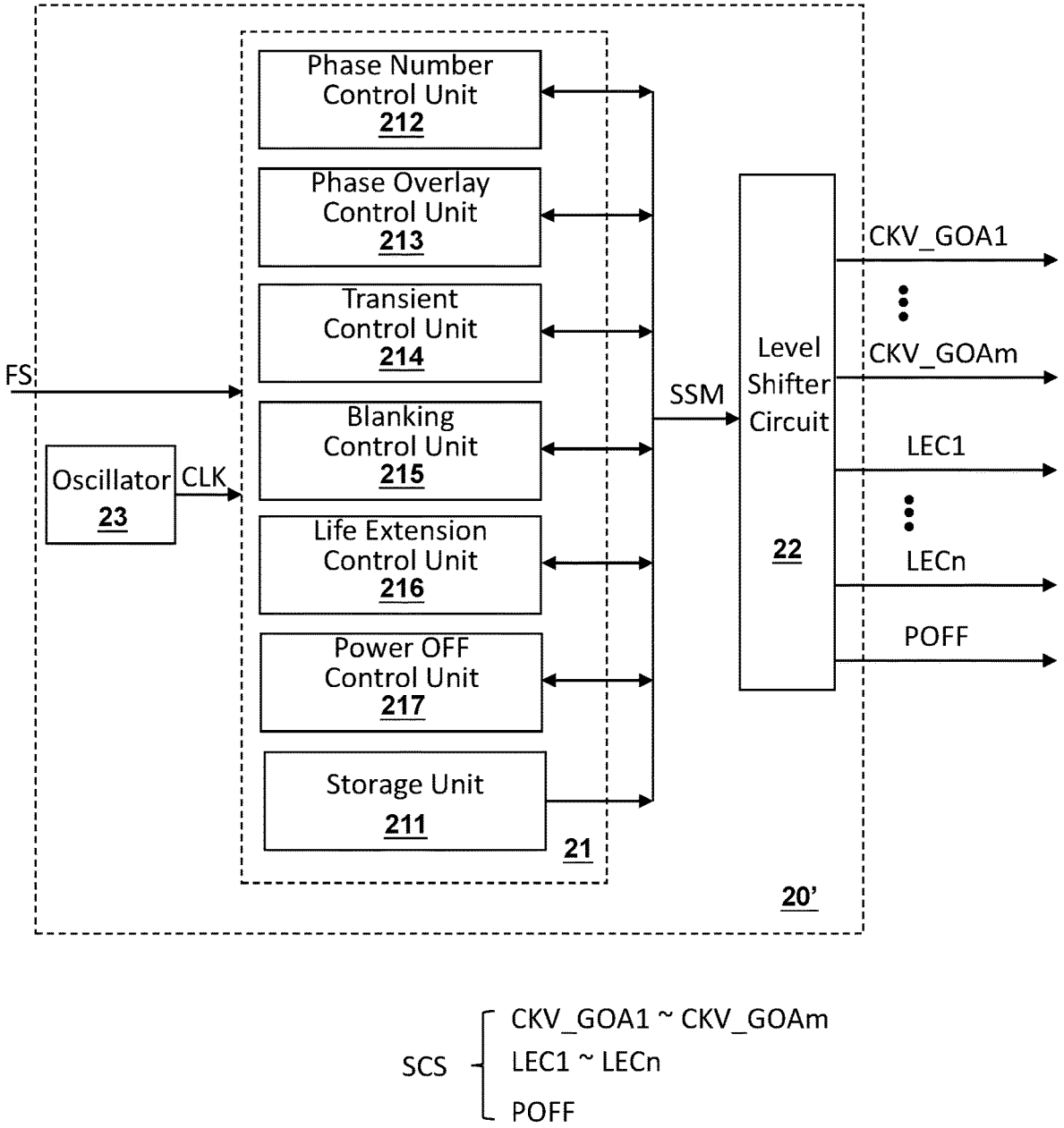
FIG. 7 shows a schematic diagram of an embodiment of the GOA control circuit of the display apparatus according to the present invention.

In another embodiment, the operation clock signal CLK is not provided from outside the GOA control circuit. FIG. 7 shows a schematic diagram of another embodiment of the GOA control circuit (GOA control circuit 20') of the display apparatus according to the present invention. In this embodiment, the GOA control circuit 20' is similar to the GOA control circuit 20 shown in FIG. 4 but differs in that the GOA control circuit 20' further includes an oscillator 23 which is configured to operably generate the operation clock signal CLK. In this embodiment, the number of the signal lines between the timing control circuit 10 and the GOA control circuit 20' is further reduced since the operation clock signal CLK is generated inside the GOA control circuit 20'.

In one embodiment, the operation clock signal CLK is synchronous with the frame synchronization signal FS. In a preferred embodiment, the operation clock signal CLK is synchronized with the falling edge of the frame synchronization signal FS, that is, the time point when the synchronization signal ends (e.g. t1 as shown in FIG. 3C). Besides, in a preferred embodiment, the frequency of the operation clock signal CLK is 5 or more times of the vertical scanning frequency VF, so that the scanning control signal SCS (such as GOA phase control signal) can have a higher resolution, whereby the image quality of the display panel circuit can be improved. Note that the vertical scanning frequency VF= (frame update rate)*(vertical resolution+vertical blanking number).

In one embodiment, the operation clock signal CLK is synchronous with the vertical scanning frequency VF of the display panel circuit 30. In another embodiment, the operation clock signal CLK is not synchronous with the vertical scanning frequency VF of the display panel circuit 30.

The aforementioned embodiments illustrate that the number of signal lines between the timing control circuit and the GOA control circuit can be greatly reduced according to the present invention. From one perspective, none of any signal lines connected between the timing control circuit and the GOA control circuit includes (1) a signal line dedicated only for transmitting the GOA phase control signal, (2) a signal line dedicated only for transmitting the life extension control signal, or (3) a signal line dedicated only for transmitting the power off signal. In one embodiment, none of any signal lines connected between the timing control circuit and the GOA control circuit includes anyone of the signal lines above.

The present invention has been described in considerable detail with reference to certain preferred embodiments thereof. It should be understood that the description is for illustrative purpose, not for limiting the scope of the present invention. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment. Furthermore, those skilled in this art can readily conceive variations and modifications within the spirit of the present invention. As an example, the source of the operation clock signal CLK may be configured to be selectable by users, for example being provided by the GOA control circuit itself (such as by the aforementioned oscillator inside the GOA control circuit) or by external circuits (such as by the timing control circuit). As another example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. The spirit of the present invention should cover all such and other modifications and variations, which should be interpreted to fall within the scope of the following claims and their equivalents.

What is claimed is:

1. A display apparatus, comprising:

a timing control circuit, configured to operably generate a frame synchronization signal; and a gate-driver on array (GOA) control circuit which is coupled to the timing control circuit, including:

a scanning signal management circuit, configured to operably generate a scanning signal management signal according to the frame synchronization signal, a predetermined panel parameter and an operation clock signal, wherein the scanning signal management circuit includes a storage unit configured to store the predetermined panel parameter; and a level shifter circuit, configured to operably generate a scanning control signal according to the scanning signal management signal to control a gate-driver on array of a display panel circuit, wherein the gate-driver on array generates a gate driving signal according to the scanning control signal to control a vertical scanning operation of the display panel circuit;

wherein the scanning control signal includes at least one of the following: (1) a GOA phase control signal for controlling a phase and/or a waveform of the gate driving signal; (2) a life extension control signal for controlling a life extension operation of the gate driving signal; and/or (3) a power off signal for controlling a power off operation of the gate driving signal;

wherein the predetermined panel parameter includes at least one of the following: (1) a phase number of the GOA phase control signal; (2) a phase overlay parameter of the GOA phase control signal; (3) a transient waveform parameter of the GOA phase control signal; (4) a life extension control signal related parameter; and/or (5) a power off signal related parameter.

2. The display apparatus of claim 1, wherein the GOA control circuit further includes an oscillator which is configured to operably generate the operation clock signal.

3. The display apparatus of claim 2, wherein the operation clock signal is synchronous with the frame synchronization signal.

4. The display apparatus of claim 2, wherein the operation clock signal is synchronous or not synchronous with a vertical scanning frequency of the display panel circuit.

5. The display apparatus of claim 1, wherein the timing control circuit provides the operation clock signal.

6. The display apparatus of claim 1, wherein the operation clock signal is not provided from outside the GOA control circuit.

7. The display apparatus of claim 1, wherein the predetermined panel parameter is one of the following: (1) a fixed value, (2) a selectable fixed value; or (3) an adjustable value; wherein the predetermined panel parameter is stored into the storage unit by a user in a setting stage.

8. The display apparatus of claim 1, wherein the scanning signal management circuit further includes at least one of the following:

a phase number control unit, configured to operably determine the phase number of the GOA phase control signal;

a phase overlay control unit, configured to operably adjust the phase overlay among the phases of the GOA phase control signal;

a transient control unit, configured to operably control a transient waveform of the GOA phase control signal;

a blanking control unit, configured to operably control a horizontal blanking time or a vertical blanking time;

a life extension control unit, configured to operably generate the life extension control signal; and/or a power off control unit, configured to operably generate the power off signal.

9. The display apparatus of claim 1, wherein none of any signal lines connected between the timing control circuit and the GOA control circuit includes (1) a signal line dedicated only for transmitting the GOA phase control signal, (2) a signal line dedicated only for transmitting the life extension control signal, or (3) a signal line dedicated only for transmitting the power off signal.

10. The GOA control circuit of claim 1, wherein the scanning signal management circuit further includes at least one of the following:

a phase number control unit, configured to operably determine the phase number of the GOA phase control signal;

a phase overlay control unit, configured to operably adjust the phase overlay among the phases of the GOA phase control signal;

a transient control unit, configured to operably control a transient waveform of the GOA phase control signal;

a blanking control unit, configured to operably control a horizontal blanking time or a vertical blanking time;

a life extension control unit, configured to operably generate the life extension control signal; and/or a power off control unit, configured to operably generate the power off signal.

11. The GOA control circuit of claim 1, wherein none of any signal lines connected between the timing control circuit and the GOA control circuit includes (1) a signal line directly corresponding to the GOA phase control signal, (2) a signal line directly corresponding to the life extension control signal, or (3) a signal line directly corresponding to the power off signal.

12. A gate-driver on array (GOA) control circuit for use in a display apparatus, the display apparatus including: a timing control circuit, configured to operably generate a frame synchronization signal; and the GOA control circuit, coupled to the timing control circuit, the GOA control circuit comprising:

a scanning signal management circuit, configured to operably generate a scanning signal management signal according to the frame synchronization signal, a predetermined panel parameter and an operation clock signal, wherein the scanning signal management circuit includes a storage unit which stores the predetermined panel parameter; and a level shifter circuit, configured to operably generate a scanning control signal according to the scanning signal management signal to control a gate-driver on array of a display panel circuit, wherein the gate-driver on array generates a gate driving signal according to the scanning control signal to control a vertical scanning operation of the display panel circuit;

wherein the scanning control signal includes at least one of the following: (1) a GOA phase control signal for controlling a phase and/or a waveform of the gate driving signal; (2) a life extension control signal for controlling a life extension operation of the gate driving signal; and/or (3) a power off signal for controlling a power off operation of the gate driving signal;

wherein the predetermined panel parameter includes at least one of the following: (1) a phase number of the GOA phase control signal; (2) a phase overlay parameter of the GOA phase control signal; (3) a transient waveform parameter of the GOA phase control signal; (4) a life extension control signal related parameter; and/or (5) a power off signal related parameter.

13. The GOA control circuit of claim 12, wherein the GOA control circuit further includes an oscillator which is configured to operably generate the operation clock signal.

14. The GOA control circuit of claims 13, wherein the operation clock signal is synchronous or not synchronous with a vertical scanning frequency of the display panel circuit.

15. The GOA control circuit of claim 12, wherein the timing control circuit provides the operation clock signal.

16. The GOA control circuit of claim 12, wherein the operation clock signal is not provided from outside the GOA control circuit.

17. The GOA control circuit of claims 16, wherein the operation clock signal is synchronous or not synchronous with a vertical scanning frequency of the display panel circuit.

18. The GOA control circuit of claim 12, wherein the predetermined panel parameter is one of the following: (1) a fixed value, (2) a selectable fixed value; or (3) an adjustable value; wherein the predetermined panel parameter is stored into the storage unit by a user in a setting stage.

* * * * *